US005685111A

United States Patent [19]

Zimmerer et al.

[11] Patent Number: 5,685,111

[45] Date of Patent: Nov. 11, 1997

[54] CONTINUOUS CABLE WINDOW REGULATOR ASSEMBLY

[75] Inventors: Jeffery J. Zimmerer, Bedford; Kevin Wayne Hill, Arlington, both of Tex.

[73] Assignee: Paccar Inc., Bellevue, Wash.

[21] Appl. No.: 528,911

[22] Filed: Sep. 15, 1995

[51] Int. Cl.[6] ..... E05F 11/48

[52] U.S. Cl. ..... 49/352

[58] Field of Search ..... 49/352, 360, 502

[56] References Cited

U.S. PATENT DOCUMENTS

| | | | |
|---|---|---|---|
| 2,260,013 | 10/1941 | Elvers | 49/352 X |
| 2,432,799 | 12/1947 | Rappl | 49/352 X |
| 4,158,270 | 6/1979 | Cherbourg et al. | 49/352 X |
| 4,416,089 | 11/1983 | Lambke, Jr. | 49/502 |
| 4,793,099 | 12/1988 | Friese et al. | 49/352 X |
| 4,934,099 | 6/1990 | Maekawa et al. | 49/352 |
| 5,002,332 | 3/1991 | Ikeda | 49/502 X |
| 5,226,259 | 7/1993 | Yamagata et al. | 49/352 X |

FOREIGN PATENT DOCUMENTS

| | | | |
|---|---|---|---|
| 133056 | 6/1949 | Australia | 49/352 |

*Primary Examiner*—Kenneth J. Dorner
*Assistant Examiner*—Curtis Cohen
*Attorney, Agent, or Firm*—Flehr Hohbach Test Albritton & Herbert LLP

[57] ABSTRACT

A door apparatus (10) having a door frame (12) providing a lower central opening (14) extending substantially across a lower central portion (14) of the frame (12), and an upper central opening (17) extending substantially across an upper central portion (16) of the frame (12) above the lower central portion (14). A movable window (18) is included mounted to the frame (12) for movement between a raised position and a lowered position. A guide assembly (21) is included cooperating with the movable window (18) for guidance thereof between the raised position and the lowered position, and a drive mechanism (22) coupled to the guide assembly (21) to selectively drive the movable window (18). The guide assembly (21) and the drive mechanism (22) are both adapted for operation and mounting along a portion of the periphery of the frame lower central portion (14) substantially out of visual obstruction of the lower central opening (13).

10 Claims, 2 Drawing Sheets

CONTINUOUS CABLE WINDOW REGULATOR ASSEMBLY

TECHNICAL FIELD

The present invention relates, generally, to window regulator assemblies for raising and lowering windows and, more particularly, to window regulator assemblies for doors for large vehicles.

BACKGROUND ART

In large semi-trucks or class eight vehicles, the operational ride height for the driver or vehicle operator is typically well above passenger vehicles. Hence, the operator is constantly looking downward from the cab to observe the spaces directly adjacent the truck which cannot be easily viewed from the conventional side mirrors. Observation of the adjacent space of the cab passenger or lower right side is especially difficult since the cab door often impedes the operator's view.

Many vehicles include a small port or safety window in the lower-half of the door which provides limited viewing of the adjacent area. These safety windows are generally relatively small and often require the addition of "domed" mirrors to enhance vision. Domed mirrors, however, distort the reflection which cause persons or objects to appear farther away than they actually are.

Increasing the size of the safety window is the logical solution; however, the safety window size is often dictated by the design and position of the window regulator assembly employed to raise and lower the movable door windows. Typically, conventional regulator assemblies are designed to couple to the bottom center of the movable window which extends down the middle of the door. In scissor-type regulator assemblies, slides are attached to the bottom of the movable window which promote stability of operation through central mounting to the window. These centrally positioned and aligned designs, however, substantially reduce the effective viewing area of the safety window.

DISCLOSURE OF INVENTION

Accordingly, it is an object of the present invention to improve the operational safety of large semi-trucks of class eight vehicles.

Another object of the present invention is to provide a door assembly for vehicle which improves the viewing area adjacent the vehicle.

It is another object of the present invention to provide a window regulator assembly for a door assembly which enables enlargement of the safety window.

Still another object of the present invention is to provide a window regulator assembly for a door assembly which improves stability of the movable window during operation.

Yet another object of the present invention is to provide a window regulator assembly which provides unobstructed viewing through a substantial lower central portion of the door.

It is a further object of the present invention to provide a window regulator assembly which is durable, compact, easy to maintain, has a minimum number of components, is easy to use by unskilled personnel, and is economical to manufacture.

The present invention includes a door apparatus having a door frame providing a lower central opening extending substantially across a lower central portion of the frame, and an upper central opening extending substantially across an upper central portion of the frame above the lower central portion. A movable window is included mounted to the frame for movement between a raised position and a lowered position. In the raised position, the movable window seals the upper central opening, while in the lowered position, the window is positioned generally parallel to and adjacent the lower central portion. The door apparatus of the present invention further includes a guide assembly cooperating with the movable window for guidance thereof between the raised position and the lowered position, and a drive mechanism coupled to the guide assembly to selectively drive the movable window. The guide assembly and the drive mechanism are both adapted for operation and mounting along a portion of the periphery of the frame lower central portion substantially out of visual obstruction of the lower central opening.

The guide assembly or window regulator apparatus includes a plurality of pulley members rotatably mounted to the frame in spaced relation proximate a generally horizontal lower periphery of the frame, and further mounted proximate at least one generally vertical side periphery thereof. A flexible tendon member extends between and rotatably supported on the pulley members in a continuous loop for reciprocating rolling support thereof along the lower periphery and the one side periphery of the frame. The regulator apparatus further includes at least one window attachment device coupled proximate a side edge portion of the window which is positioned along the one side periphery for reciprocating the window between the raised position and the lowered position as the attachment device reciprocates along the one side periphery.

BRIEF DESCRIPTION OF THE DRAWING

The assembly of the present invention has other objects and features of advantage which will be more readily apparent from the following description of the Best Mode of Carrying Out the Invention and the appended claims, when taken in conjunction with the accompanying drawing, in which:

BEST MODE OF CARRYING OUT THE INVENTION

Figure 1A:
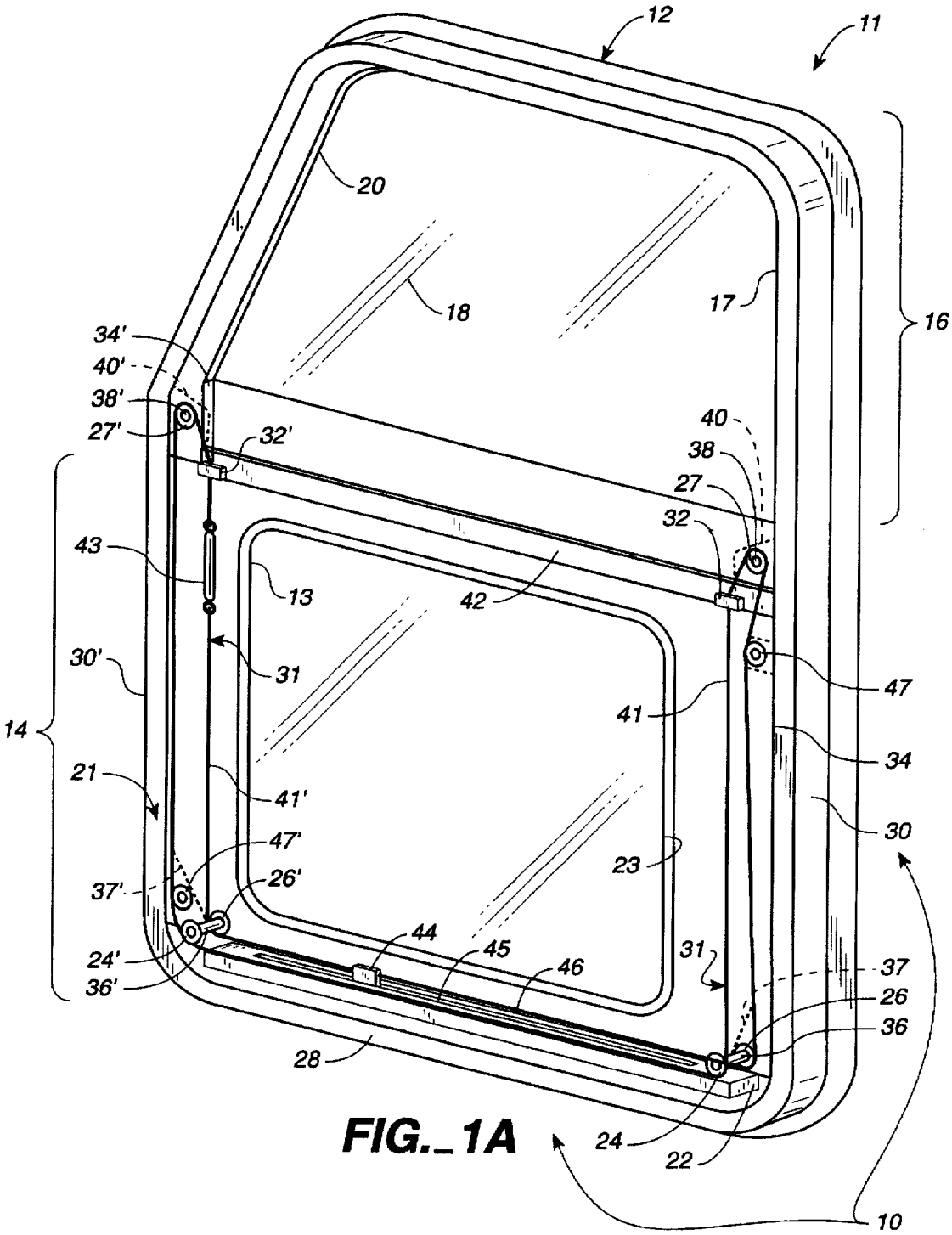
FIGS. 1A and 1B are top perspective views of a door assembly housing a window regulator assembly constructed in accordance with the present invention, and illustrating operation thereof between a raised position and a lowered position, respectively.

The following description is presented to enable a person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded with the widest scope consistent with the principles and features disclosed herein. It will be noted here that for a better understanding, like components are designated by like reference numerals throughout the various figures.

Figure 1B:
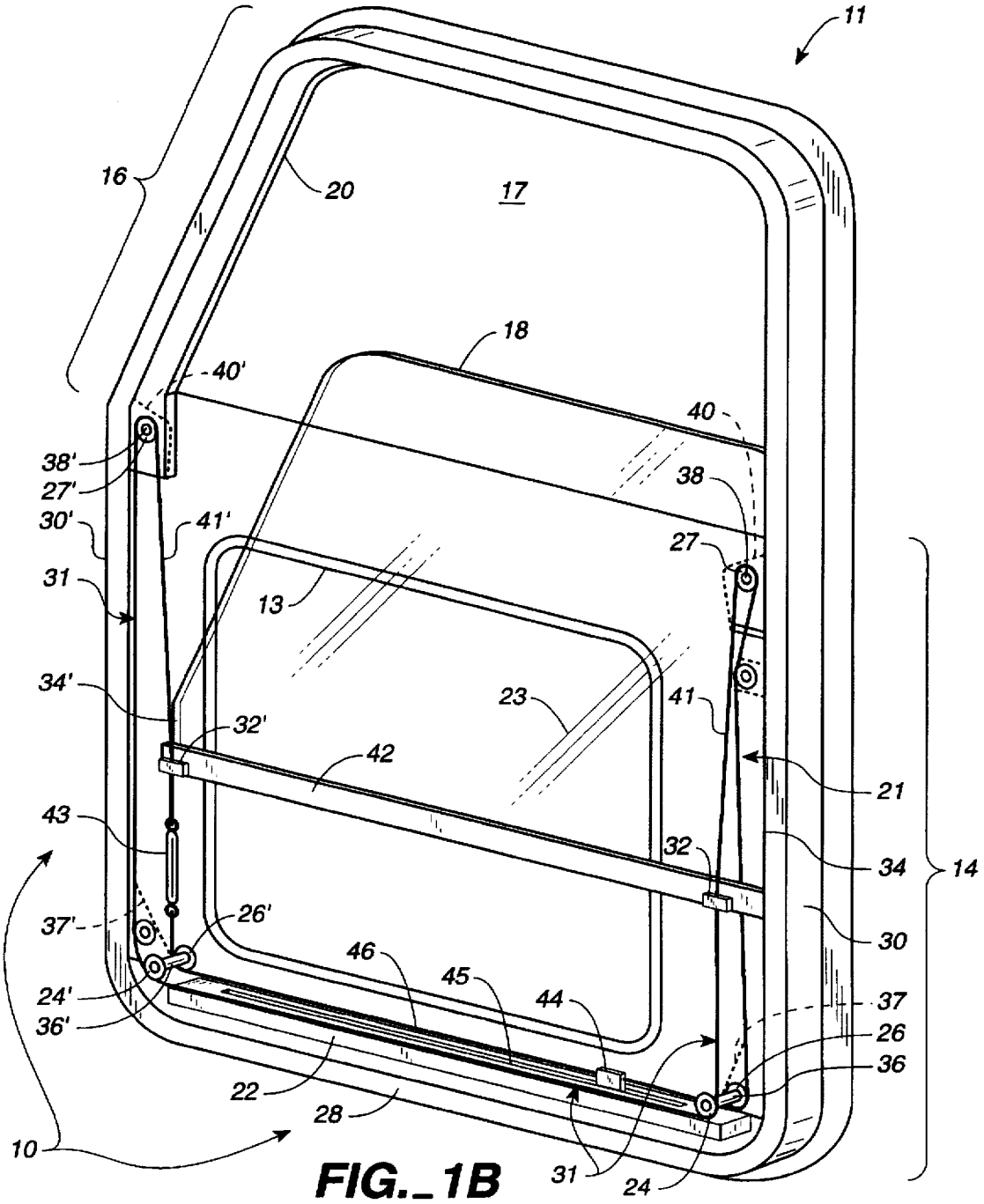

Attention is now directed to FIGS. 1A and 1B, where the subject window regulator apparatus, generally designated 10, is shown operationally mounted to a vehicle door apparatus 11. Briefly, the door apparatus 11 includes a door frame 12 providing a lower central opening 13 extending substantially across a lower central portion 14 of frame 12. Frame 12 further includes an upper central opening 17 extending substantially across an upper central portion 16 of the frame which is still above lower central portion 14. A movable window, generally designated 18, is included mounted to frame 12 through a sliding guide track 20 for movement of the window between a raised position (FIG. 1A) and a lowered position (FIG. 1B). In the raised position, movable window 18 seals upper central opening 17, while in the lowered position, the window is positioned generally parallel to and adjacent lower central portion 14.

The window regulator apparatus 10 of the present invention further includes a guide assembly, generally designated 21, cooperates with the movable window for guidance and movement thereof between the raised position and the lowered position. A drive mechanism 22 is provided coupled to guide assembly 21 to selectively drive the movable window. In accordance with the present invention, guide assembly 21 and drive mechanism 22 are both adapted for operation and mounting along a portion of the periphery of frame lower central portion 14 substantially out of visual obstruction of lower central opening 13.

Accordingly, the window regulator assembly of the present invention is positioned along the periphery of the lower central portion of the frame so that the operation thereof does not structurally infringe upon a substantial whole of the frame lower central portion. This enables a substantial increase in the size of the lower central opening 13, to which a safety window 23 is positioned, without viewing interference from the window regulator assembly. In turn, safety of operation of the vehicle is increased.

The guide assembly or window regulator apparatus 21 includes a plurality of pulley members (24, 24', 26, 26', 27 and 27') rotatably mounted to frame 12 in spaced relation along a generally horizontal lower periphery 28 thereof, and further mounted to at least one generally vertical side periphery 30 of frame 12. Regulator apparatus 10 further includes a flexible tendon member or the like, generally designated 31, which extends between and is rotatably supported on the pulley members in a continuous loop. This rolling support enables reciprocating movement of the tendon member along the lower periphery 28 and at least the one side periphery 30 of the frame.

The regulator apparatus further includes at least one window attachment device, generally designated 32, coupling tendon member 31 to a side edge portion 34 of movable window 18. Window attachment device 32 is formed to vertically reciprocate between the pulley members (27 and 24) generally along side periphery 30, as shown in FIGS. 1A and 1B, causing movable window 18 to be reciprocated between the raised position and the lowered position.

In the preferred embodiment of the present invention, however, the pulley members also are positioned along a generally vertical opposite side periphery 30' of the frame lower central portion 14. This enables tendon member 31 to further extend along opposite side periphery 30' so that the continuous loop tendon member is substantially U-shaped when properly supported about the pulley members. Similar to first attachment device 32, an opposite window attachment device 32' couples the tendon member along side an opposite edge portion 34' of movable window 18. As will be described in greater detail below, the two attachment devices 32, 32' cooperate with the tendon member 31 and the spaced-apart edge portions 34, 34' to stably urge movable window 18 along the sliding guide track 20 between the raised position (FIG. 1A) and the lowered position (FIG. 1B). Accordingly, the U-shaped tendon member extends about the periphery of the lower central portion to provide a substantially unobstructed view of a substantial portion of the lower central portion. This enables placement of a much larger safety window 23 than the prior art window regulator assemblies.

While it will be appreciated that the present invention may properly function and operate with only one window attachment device mounted to the window, the preferred arrangement incorporates the two attachment devices shown in FIGS. 1A and 1B. These attachment devices 32, 32' are laterally spaced-apart and coupled to movable window 18 near its extreme edge portions 34, 34'. The position of the attachment devices is structurally beneficial over the prior art centrally mounted regulator assemblies in that the configuration of the present invention improves the stability of movable window 18 during sliding movement along guide track 20. Hence, skewing or cocking of the movable window is reduced as the window moves relative the guide track between the raised and the lowered positions.

FIGS. 1A and 1B illustrate that the pulley members include a pair of corner pulleys 24, 26 rotatably mounted to a lower corner of lower central portion 14 between side periphery 30 and lower periphery 28. Each pulley 24, 26 of the first named pair of corner pulleys independently rotates about a common, generally horizontally positioned lower shaft or rod 36. This enables the continuous loop tendon member 31 to move along the pulley members since the portions of the tendon member rotatably contacting the corner pulleys 24, 26 will be moving in opposite directions.

Similarly, another pair of opposite corner pulleys 24', 26' are rotatably mounted to an opposite lower corner of the frame lower central portion between opposite side periphery 30 and lower periphery 28. Each pulley 24', 26' of this pair of opposite corner pulleys, likewise, independently rotates about a common, generally horizontally positioned, opposite lower shaft 36'.

The lower central portion of frame 12 may further include corner support brackets 37, 37' (shown in phantom lines) situated at the respective corners upon which lower shafts 36, 36' are mounted, respectively. These support brackets may be provided by any bracket capable of supporting the lower shafts for rotation of the pulleys about generally horizontal axes.

Rolling support of tendon member 31 is further provided by an upper pulley 27 positioned above window attachment device 32, and rotatably mounted to the side periphery 30 about a generally horizontally positioned upper shaft 38. Upper pulley 27 is preferably mounted proximate the top of side periphery 30 enabling window attachment device 32 to reciprocate therebetween. Likewise, an opposite upper pulley 27' is positioned above opposite attachment device 32' and rotatably mounted to the opposite side periphery 30 about a generally horizontally positioned opposite upper shaft 38'. Opposite upper pulley 27' is preferably mounted proximate the top of opposite side periphery 30 which enables opposite attachment device 32' to reciprocate therebetween.

Upper shafts 38, 38' are preferably mounted to the corresponding frame side peripheries 30, 30' through upper support brackets 40, 40' (shown in phantom lines) situated at or near the top thereof. These upper support brackets, as well as the lower corner support brackets, are situated generally perpendicular to the direction of movement of the tendon member to enable proper rotation of the pulley members thereabout.

Tendon member 31 is preferably provided by a flexible metal cable or cord formed to cooperate with and rotatably engage the pulleys for reciprocating movement thereabout. As viewed in FIGS. 1A and 1B, cable member 31 preferably spans or extends from upper pulley 27 down to corner pulley 24, and onto opposite corner pulley 24'. The cable member then extends up to and around opposite upper pulley 27', down to opposite corner pulley 26' and onto corner pulley 26. The continuous loop is completed as the cable member extends up to and around upper pulley 27. Accordingly, the cable member reciprocates and travels a continuous path about the pulley members to enable movement of the attachment devices therealong.

The edge portion 34 of movable window 18 is preferably coupled to a generally vertical first actuating span portion 41 of cable member 31 through window attachment device 32. The first actuating span portion is essentially the span of cable, at any point in time, extending between upper pulley 27 and corner pulley member 24 upon which attachment device 32 reciprocates. The opposite edge portion 34' of movable window 18 is coupled to a generally vertical second actuating span portion 41' of cable member 31, via opposite attachment device 32', between opposite upper pulley 27' and opposite corner pulley 26' upon which the opposite attachment device reciprocates. Therefore, as cable member 31 reciprocates along the pulley members, the first and second actuating span portions 41, 41' urge the respective attachment devices 32, 32' in the substantially same direction and at substantially the same rate to uniformly and stably move the edge portions of window along guide track 20 between the lowered position and the raised position.

Movable window 18 may include a snap fit U-shaped bracket 42 or the like affixed to the bottom edge thereof. Attachment devices 32, 32' are preferably mounted to U-shaped bracket 42 at one side wall thereof to enable coupling to the respective actuating span portions of the mounting cable. It is noted that virtually any attachment device capable of permanently or removably attaching the cable member to the window may be employed.

A turnbuckle 43 may be included positioned in the cable member between one of the span portions. Turnbuckle 43 is provided to adjust the slack in the continuous cable line, and further provides the vehicle to couple the ends of the cable member together.

As set forth above, a drive mechanism 22 is provided coupled to cable member 31 to selectively drive or propel the movable window between the raised position and the lowered position. The drive mechanism is coupled to the cable member through a drive attachment device 44 in a manner similar to the window attachment devices which couple the cable member to the window edge portions. Preferably, drive mechanism 22 is situated along the lower periphery 28 of the frame lower central portion extending in the direction of and generally parallel to the portions of the cable member spanning the corner pulleys.

As viewed in FIGS. 1A and 1B, drive mechanism 22 reciprocates drive attachment device 44 between corner pulleys which reciprocates the cable member about the pulleys. In turn, the corresponding window attachment devices are caused to move between the actuating span portions which drives the movable window between the lowered and raised positions.

Drive mechanism 22 is thus an elongated device formed and dimensioned to slidably reciprocate drive attachment device 44 along slot 45 in a generally horizontal direction substantially in the direction of the driving span 46 of cable member 31 between the corresponding corner pulleys. Preferably, the driving span portion upon which the drive attachment device is coupled is situated between corner pulley 26 and opposite corner pulley 26'. It will be appreciated, however, that the drive attachment device could easily be attached to the span portion between corner pulley 24 and opposite corner pulley 24', as well as the vertical span portions between the upper pulleys 27, 27' and the corner pulleys 26, 24', respectively.

In the preferred form, drive mechanism 22 is pneumatically operated through air compression means (not shown). Hence, drive mechanism 22 may be provided by a double acting air cylinder device or the like coupled to driving attachment device 44 for movement thereof between driving span portion 46. Further, it will be understood that the driving mechanism may be provided by any electromechanical or manually movable device capable of reciprocating the driving attachment device along the driving span portion.

The regulator apparatus of the present invention may further include alignment pulleys, such as alignment pulley 47 rotatably positioned proximate upper pulley 27, or opposite alignment pulley 47' positioned proximate opposite corner pulley 24. These alignment pulleys facilitates alignment of the cable member with the pulleys, or they position the corresponding span portion (i.e., between upper pulley 27 and corner pulley 26 or opposite upper pulley 27' and opposite corner pulley 24') clear of interference with movable window 18 during reciprocating movement between raised and the lowered positions.

What is claimed is:

1. A door apparatus comprising:

a door frame defining a lower central opening extending substantially across a lower central portion of said frame, and an upper central opening extending substantially across an upper central portion of said frame above said lower central portion;

a movable window mounted to said frame for movement between a raised position, substantially closing said upper central opening, and a lowered position, generally parallel to said lower central portion;

a guide assembly cooperating with said movable window for guidance thereof between said raised position and said lowered position, said guide assembly including a plurality of pulley members rotatably mounted to said frame in spaced relation proximate a generally horizontal lower periphery of the frame lower central portion, and proximate at least one generally vertical side periphery thereof, said plurality of pulley members being further positioned proximate a generally vertical opposite side periphery of the frame, and a flexible tendon member extending between and rotatably supported on said pulley members in a continuous loop for reciprocating rolling support thereof along said lower periphery and the one side periphery of said frame, and including at least one window attachment device coupled proximate an edge portion of said window and positioned along said one side periphery for reciprocating said window between said raised position and said lowered position as said attachment device reciprocates along said one side periphery, and said tendon member further extending down said opposite side periphery thereof, across said lower periphery and up said one side periphery, and back around and down said one side periphery, back across said lower periphery, and back up said opposite side periphery to form said continuous loop;

a drive mechanism coupled to said guide assembly to selectively drive said movable window between said raised position and said lowered position, said guide assembly and said drive mechanism both being adapted for operation and mounting along a portion of the periphery of the frame lower central portion substantially out of visual obstruction of said lower central opening; and an opposite window attachment device coupled proximate an opposite edge portion of said movable window and positioned along said opposite side periphery for reciprocating said window between said raised position and said lowered position as the opposite attachment device reciprocates along said opposite side periphery.

2. The door apparatus as defined in claim 1 wherein, said pulley members include a pair of corner pulleys positioned proximate a lower corner of said lower central portion between said lower periphery and said one side periphery, and an opposite pair of corner pulleys positioned proximate an opposite lower corner of said lower central portion between said lower periphery and said opposite side periphery.

3. The door apparatus as defined in claim 2 wherein, said first pair of corner pulleys rotate about a common first generally horizontal axis, and said second pair of corner pulleys rotate about a common second generally horizontal axis.

4. The door apparatus as defined in claim 2 wherein, said pulley members further include an upper pulley rotatably mounted proximate said one side periphery of said frame and above said one window attachment device enabling reciprocation of said one window attachment device therebetween, an opposite upper pulley rotatably mounted proximate said opposite side periphery and above said opposite window attachment device enabling reciprocation of said opposite window attachment device therebetween.

5. The door apparatus as defined in claim 4 wherein, said pulley members further include an alignment pulley rotatably mounted between said upper pulley and said pair of corner pulleys for aligning said tendon member with said upper pulley, and an opposite alignment pulley rotatably mounted between said opposite upper pulley and said opposite pair of corner pulleys for aligning said tendon member with said opposite upper pulley.

6. The door apparatus as defined in claim 4 further including:

a lower window coupled to said lower central portion in a manner sealing said lower central opening.

7. A window regulator apparatus for a door havinq a frame and a movable window cooperating with said frame for movement of said window between a lowered position and a raised position, said regulator apparatus comprising:

a plurality of pulley members rotatably mounted to said frame in spaced relation proximate a generally horizontal lower periphery of said frame, and proximate at least one generally vertical side periphery thereof, said plurality of pulley members being further positioned proximate a generally vertical opposite side periphery of the frame;

a flexible tendon member extending between and rotatably supported on said pulley members in a continuous loop for reciprocating rolling support thereof along said lower periphery and the one side periphery of said frame with said tendon member further extending down the opposite side periphery thereof, across said lower periphery and up said one side periphery, and back around and down said one side periphery, back across said lower periphery, and back up said opposite side periphery to form said continuous loop; and at least one window attachment device coupled proximate a side edge portion of said window and positioned along said one side periphery for reciprocating said window between said raised position and said lowered position as said attachment device reciprocates along said one side periphery, and an opposite window attachment device coupled proximate an opposite edge portion of said window and positioned along the frame opposite side periphery for reciprocating said window between said raised position and said lowered position as the opposite attachment device reciprocates along said frame opposite side periphery.

8. The window regulator apparatus as defined in claim 7 wherein, said pulley members include a pair of corner pulleys positioned proximate a lower corner of said frame between said lower periphery and said one side periphery, and an opposite pair of corner pulleys positioned proximate an opposite lower corner of said frame between said lower periphery and said opposite side periphery.

9. The window regulator apparatus as defined in claim 8 wherein, said first pair of corner pulleys rotate about a common first generally horizontal axis, and said second pair of corner pulleys rotate about a common second generally horizontal axis.

10. The window regulator apparatus as defined in claim 8 wherein, said pulley members further include an upper pulley rotatably mounted proximate said one side periphery of said frame and above said one window attachment device enabling reciprocation of said one window attachment device therebetween, and an opposite upper pulley rotatably mounted proximate said opposite side periphery of said frame and above said opposite window attachment device enabling reciprocation of said opposite window attachment device therebetween.

* * * * *